US005096257A

United States Patent [19]

Clark

[11] Patent Number: 5,096,257

[45] Date of Patent: Mar. 17, 1992

[54] SUNSHADE APPARATUS FOR CHAIR

[75] Inventor: Brian L. Clark, 28521 Rancho de Juana, Laguna Niguel, Calif. 92656

[73] Assignee: Brian L. Clark, Laguna Niguel, Calif.

[21] Appl. No.: 675,300

[22] Filed: Mar. 26, 1991

[51] Int. Cl.[5] ..... A47C 7/10

[52] U.S. Cl. ..... 297/184; 135/96

[58] Field of Search ..... 297/184; 135/96, 106, 135/107, 108, 109, 117

[56] References Cited

U.S. PATENT DOCUMENTS 3,404,915 10/1968 de Souza Filho ..... 297/184 X
4,470,630 9/1984 Shields ..... 297/184 X
4,781,411 11/1988 Kolb ..... 297/184

FOREIGN PATENT DOCUMENTS 2655028 6/1978 Fed. Rep. of Germany ..... 297/184

*Primary Examiner*—Laurie K. Cranmer

[57] ABSTRACT

An adjustable sunshade apparatus for providing shade to a person in a recreational chair, the apparatus comprising a canopy structure for supporting a fabric cover and adjustably attached to two parallel shade support arms. A pair of clamps holds the shade support arms to the back of the chair. The canopy structure is dismantled so that the support arms and canopy components lie adjacent and parallel, and so that the clamps, canopy components, and support arms may be wrapped in the fabric cover to achieve a conveniently carried roll. The sunshade apparatus is easily assembled, dismantled, and ported.

5 Claims, 3 Drawing Sheets

SUNSHADE APPARATUS FOR CHAIR

FIELD OF THE INVENTION

This invention relates to sunshade apparati for attachment to recreational chairs and the like. More particularly, this invention relates to sunshade apparati that are also conveniently dismantled and ported.

BACKGROUND OF THE INVENTION

There are a wide variety of recreational chairs that are used outdoors, such as beach chairs, patio chairs, and the like. As people have become more aware of the damage that sunlight can do to their skin, the demand for a convenient sunshade for such chairs has grown.

A current method of shading a person is to set-up a relatively large umbrella near the person's chair. While this provides shade from the sun, it is clearly inappropriate for situations where the umbrella will interfere with another person's view, such as at a sporting event or the like. Moreover, large umbrellas of this type are bulky and difficult to set-up and work with. Consequently, the large umbrella is frequently inconvenient to use.

Several sunshade apparati have been introduced specifically for attachment to recreational chairs and lounges. Most of these utilize an adjustable upper canopy that is a great deal smaller and less obtrusive than an umbrella. While some of these sunshade apparati are permanently attached to a chair or lounge, many are detachable and, consequently, transferable from chair to chair.

To date, then, sunshade apparati are relatively convenient to adjust and use. However, the development of a sunshade apparatus that is also convenient to assemble, dismantle, and transport has been overlooked. Current sunshade apparati are constrained in at least one dimension to, at a minimum, the size of the area of their canopy, as folding canopies are not in the current technology. Consequently, an easily assembled, disassembled, and portable sunshade apparatus that is also fully adjustable and adaptable to most recreational chairs is needed.

SUMMARY OF THE INVENTION

The present invention is an adjustable sunshade apparatus utilizing a canopy comprised of a U-shaped rigid structure supporting a fabric cover. The canopy cooperates with two support arms to provide an adjustable sunshade for a person sitting in a recreation chair. The two support arms attach to the recreational chair with common clamps, and are adjustable in height to accommodate persons of various sizes.

The U-shaped rigid structure of the canopy is comprised of three interlocking tubes that, when disassembled, may be oriented generally parallel with each other and wrapped along with the support arms and clamps, in the fabric cover to form a conveniently carried roll.

This apparatus achieves the adjustability of previous sunshade apparati and the adaptability of attachment to most recreational chairs. Moreover, it is easily dismantled into a convenient size and shape for portability.

Other features and advantages of the present invention will become apparent from the following more detailed description, taken in conjunction with the accompanying drawings, which illustrate, by way of example, the principles of the invention.

DESCRIPTION OF THE DRAWINGS

The accompanying drawings illustrate the invention. In such drawings.

DETAILED DESCRIPTION OF THE INVENTION

Figure 1:
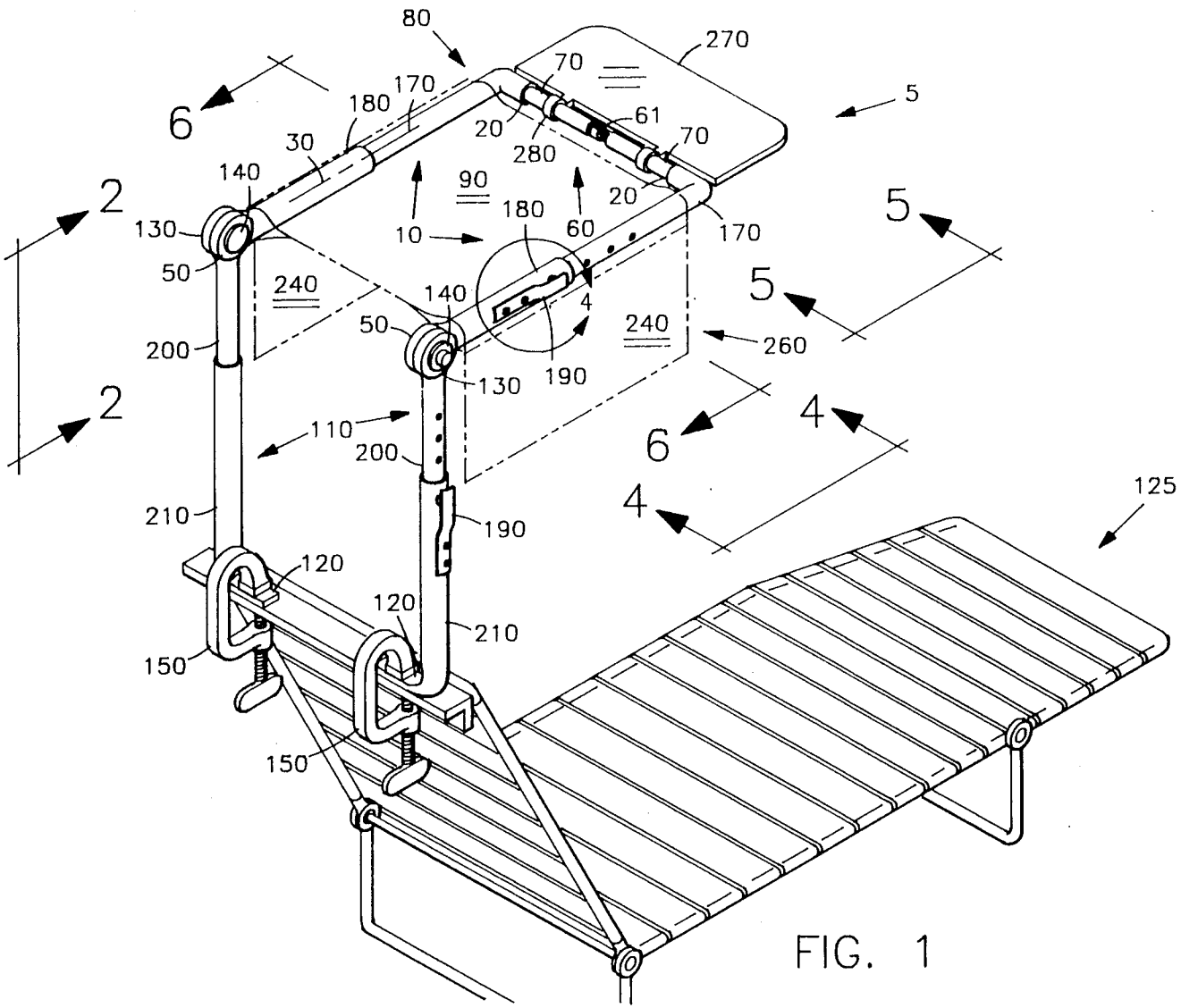
FIG. 1 is a perspective view of the invention as attached to a chair.
Figure 2:
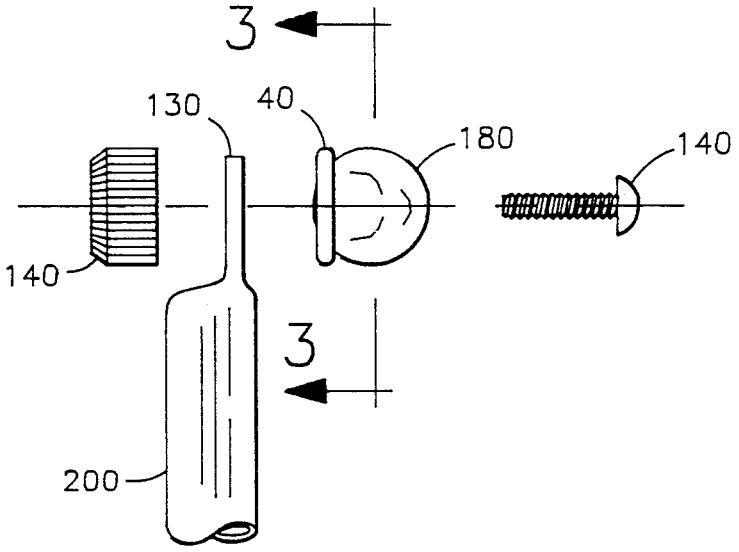
FIG. 2 is an exploded rear elevation view of the invention, taken generally along lines 2—2 of FIG. 1.
Figure 3:
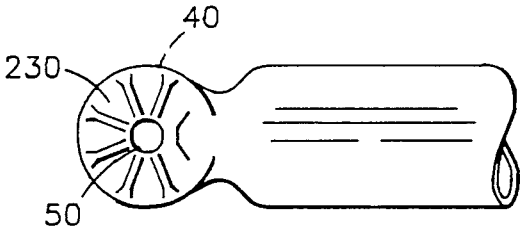
FIG. 3 is a right side elevation view of the cover support arm of the invention, taken generally along lines 3—3 of FIG. 2.
Figure 4:
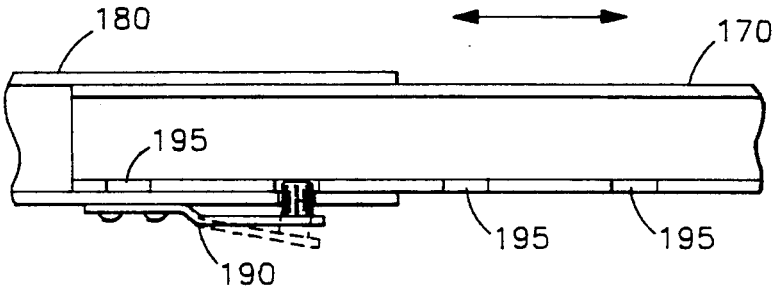
FIG. 4 is a right side elevation cut-away view of the cover support arm of the invention, taken generally along lines 4—4 of FIG. 1.

FIG. 1 shows a sunshade apparatus attached to a chair 125 comprised of a pair of tubular, horizontally disposed, mutually parallel cover support arms 10. Each cover support arm 10 has one open end 20 bent at right angles to a long axis 30 of the cover support arm 10. The other end 40 of the cover support arm 10 is flattened with a hole 50 therethrough. The cover support arms 10 may be made from hollow tubes of either plastic or metal. In one embodiment of the invention, each cover support arm 10 comprises a first portion 170 and a second portion 180, the first portion 170 fitting within the second portion 180 for telescoping action in order to change the length of the cover support arm 10. A locking means 190 locks the first portion 170 and second portion 180 at several relative extensive positions. Clearly, a number of common locking means 190 may be utilized, only one of which is illustrated in FIGS. 1 and 4.

Figure 6:
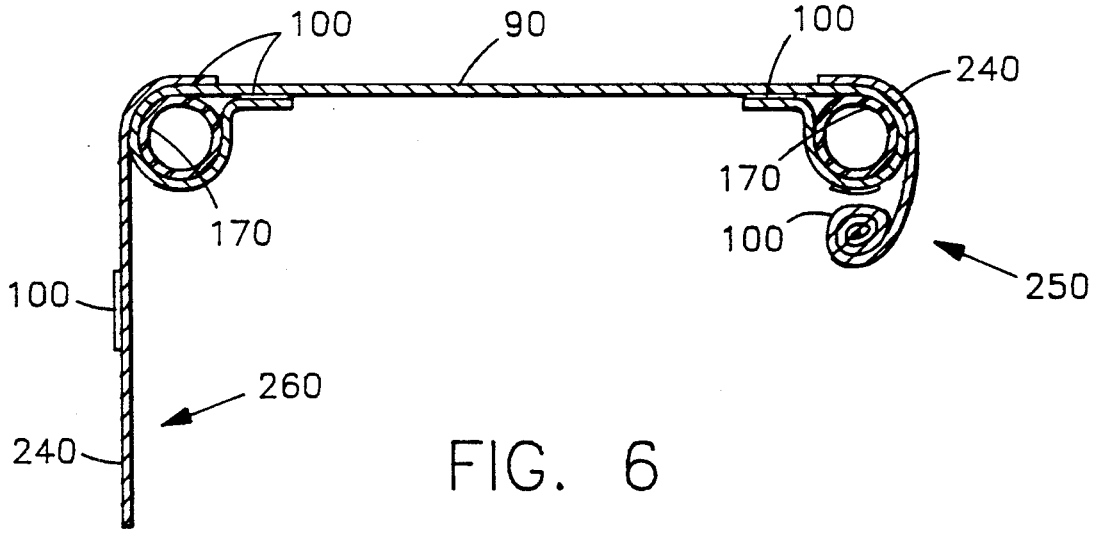
FIG. 6 is a front elevation cut-away view of the invention, taken generally along lines 6—6 of FIG. 1.

A tubular cross arm 60, also made from a hollow tube of either plastic or metal, has ends 70. Each end 70 is inserted into a frictionally held in one open end 20 of each cover support arm 10, thereby forming a U-shaped rigid structure 80. Cross arm 60 may have hinge 61 at its center dividing it into two colinear portions providing a means for folding the cross arm 60. A fabric cover 90 is stretched over the U-shaped rigid structure 80, the fabric cover 90 having means for attachment thereto. The fabric cover 90 may be a sheet of opaque or translucent material with hook-and-loop type fastener material for attachment around the cover support arms 10. Another embodiment of the invention provides fabric portions 240, and a means for supporting the fabric portions 240 in a first unextended position 250 or a second extended position 260, the second extended position 260 for blocking sunlight from low lateral angles. Fabric portions 240 are illustrated in FIG. 6.

Figure 5:
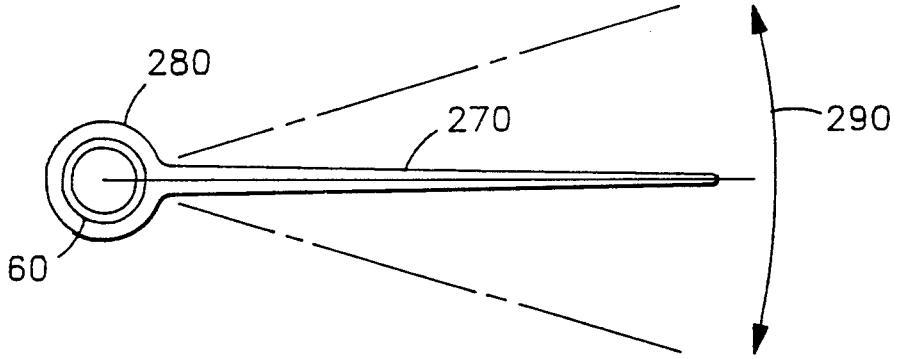
FIG. 5 is a right side elevation view of the rigid visor of one embodiment of the invention, taken generally along lines 5—5 of FIG. 1.

A rigid visor 270 is attached, in one embodiment of the invention, to the cross arm 60 with adjustment means 280 of the rigid visor 270 over a range of angles 290 for convenient placement for blocking sunlight from low frontal angles. The rigid visor 270 is illustrated in FIGS. 1 and 5.

A pair of tubular, vertically disposed, and mutually parallel shade support arms 110, each having chair back attachment means 120 at one end, are flattened at the other end 130 with one hole 50 therethrough. In one embodiment of the invention, each shade support arm 110 comprises a first portion 200 and a second portion 210, the first portion 200 fitting within the second portion 210 for telescoping action in order to change the length of the shade support arm 110. A locking means 190 locks the first portion 200 and second portion 210 at several relative extensive positions. Clearly, a number of common locking means 190 may be utilized, only one of which is illustrated in FIG. 1.

A pair of means for attachment 140 such as bolts thereon are provided for pivotally attaching each flattened end 40 of the cover support arm 10 to each flattened end 130 of the shade support arms 110. The nuts may be wing nuts, or the like, to facilitate manual loosening and tightening. In one embodiment, each flattened end 40 and 130 has a pattern 230 of radial corrugations so that when the bolts with nuts are tightened, forcing two flattened ends 40 and 130 into contact, the radial corrugations interlock and cause the flattened ends 40 and 130 to be locked in angular alignment at a selected angular position.

Clamping means 150 is provided for holding the chair back attachment means 120 to the back of the chair 125, thereby providing support for the sunshade apparatus in order to shade the chair 125, and any occupant thereof, from the sun, rain, and the like. The chair 125 could be any number of recreational or other chairs, including wheel chairs, lifeguard chairs, stadium chairs, beach chairs, golf cart chairs, park benches, and so on. Moreover, the clamping means 150 are clearly not limited to holding the chair back attachment means 120 to the back of a chair 125, but rather could easily hold the chair back attachment means 120 to any number of suitable structures including lifeguard towers, vehicles, window sills, and any other structure that may conveniently support the sunshade apparatus.

The sunshade apparatus may be easily dismantled for convenient portage by loosening the bolts 140, folding each shade support arm 110 to parallel each cover support arm 10, and removing the cross arm 60 from the open end 20 of each cover support arm 10 and placing the cross arm 60 adjacent and parallel to each shade support arm 110. Each clamping 150 is removed and placed adjacent to the parallel shade support arms 110, cover support arms 10, and cross arm 60, all of which are then wrapped within the fabric cover 90 to achieve a conveniently carried roll (not shown). The rigid visor 270 and fabric portions 240 may be wrapped into the roll in a similar manner. The sunshade apparatus is assembled by following the reverse process.

While the invention has been described with reference to several embodiments, it is to be clearly understood by those skilled in the art that the invention is not limited thereto. Rather, the scope of the invention is to be interpreted only in conjunction with the appended claims.

What is claimed is:

1. A sunshade apparatus comprising:

a pair of horizontally disposed mutually parallel, cover support arms, each cover support arm having one open end, said open end being bent at right angles to the long axis of the cover support arm, the other end being flattened in the vertical plane with a hole therethrough;

a cross arm having two ends and having two colinear portions pivotally joined, said cross arm joining said cover support arms by insertion of the ends of the cross arm into said open ends of said cover support arms thereby forming a U-shaped rigid structure;

a fabric cover stretched over said U-shaped structure, said fabric cover having means for attachment thereto;

a pair of vertically disposed, mutually parallel, shade support arms, each arm having means for chair back attachment at one end, the other end being flattened in the vertical plane with a hole therethrough;

a pair of means for attachment for pivotally connecting said flattened ends of each said cover support arm with each said shade support arm;

a pair of clamping means, each said clamping means providing temporary connection between a chair and one said shade support arm, such that the fabric is positioned over the chair for shading the chair, whereby said sunshade apparatus may be easily collapsed for convenient carrying by folding said cross arm colinear portions so that the cover support arms are adjacent and parallel, and by folding said shade support arms so that the shade support arms are adjacent and parallel to the cover support arms forming a compact package.

2. The apparatus of claim 1 wherein each said cover support arm comprises a first and a second portion, said first portion fitting within said second portion for telescoping action with means for locking said portions at several extensive positions whereby said cover support arms may assume a length of convenience for shading more or less of said chair.

3. The apparatus of claim 1 wherein each said shade support arm comprises a first and a second portion, said first portion fitting within said second portion for telescoping action with means for locking said portions at several extensive positions whereby said shade support arms may assume a length of convenience for adjustment of height.

4. The apparatus of claim 1 wherein said means for attachment of said fabric cover is a hook and loop type fastener.

5. The apparatus of claim 1 further including a rigid visor attached to said cross arm with means for adjustment of said visor over a range of angles for convenient placement for blocking sunlight from low frontal angles.

* * * * *